US005431576A

United States Patent [19]

Matthews

[11] Patent Number: 5,431,576

[45] Date of Patent: Jul. 11, 1995

[54] ELECTRICAL POWER CONNECTOR

[75] Inventor: Russell H. Matthews, Modesto, Calif.

[73] Assignee: Elcon Products International, Fremont, Calif.

[21] Appl. No.: 274,555

[22] Filed: Jul. 14, 1994

[51] Int. Cl.[6] ..... H01R 13/64

[52] U.S. Cl. ..... 439/247; 439/843

[58] Field of Search ..... 439/843–846, 439/856–857, 247–251, 176

[56] References Cited

U.S. PATENT DOCUMENTS

| | | | |
|---|---|---|---|
| 3,808,578 | 4/1974 | Hansen | 439/595 |
| 4,379,611 | 4/1983 | Foege et al. | 439/747 |
| 4,728,163 | 3/1988 | Kittinger et al. | 439/172 |
| 4,824,380 | 4/1989 | Matthews | 439/78 |
| 4,867,713 | 9/1989 | Ozu et al. | 439/833 |
| 5,088,942 | 2/1992 | Welsh et al. | 439/843 |
| 5,211,589 | 5/1993 | McCardell | 439/879 |
| 5,261,840 | 11/1993 | Benz | 439/843 |
| 5,306,182 | 4/1994 | Fukushima et al. | 439/857 |
| 5,342,226 | 8/1994 | Hayes et al. | 439/845 |

FOREIGN PATENT DOCUMENTS

| | | | |
|---|---|---|---|
| 0549960 | 7/1993 | European Pat. Off. | 439/247 |

OTHER PUBLICATIONS

"AMP PDS (Power Distribution System)" Series 125F bus bar connector, AMP Incorporated, P.O. Box 3608, Harrisburg, Pa. 17105.

"AMP PDS (Power Distribution System)" Series 125F2 bus bar connector, AMP Incorporated, P.O. Box 3608, Harrisburg, Pa. 17105.

"ILSCO M-165" bus bar connector, ILSCO, 4730-T Madison, Cincinnati, Ohio 45227.

*Primary Examiner*—Larry I. Schwartz
*Assistant Examiner*—Jill DeMello
*Attorney, Agent, or Firm*—Burns, Doane, Swecker & Mathis

[57] ABSTRACT

An electrical power connector having a housing that substantially surrounds a mounting body. The mounting end of the mounting body extends beyond the end of the housing so that when the electrical connector is mounted on a back plane there is a gap between the end of the housing and the back plane which allows the electrical power connector freedom to pivot with respect to the back plane so as to accommodate misalignment between the electrical power connector and its mating connector and to provide a better electrical connection. An electrically conducting arm is also provided that can be inserted into the mounting body of the electrical power connector to convert the electrical power connector from a female connector to a male connector.

35 Claims, 11 Drawing Sheets

ELECTRICAL POWER CONNECTOR

BACKGROUND OF THE INVENTION

The present invention relates generally to electrical power connectors. More particularly, the invention concerns an electrical power connector used with rack-mounted electrical equipment, the connector being attached to the rack and having multiple degrees-of-freedom in movement for receiving a mating connector.

In conventional rack-mounted electrical equipment, a cabinet has vertically spaced rack mountings and a back. Modular components are supported by corresponding rack mountings so that the components can slide into and out of the cabinet. To provide electrical power to the modular components, the cabinet back typically includes one or more continuously powered bus bars and/or back planes. Each modular component normally includes one part of an electrical connector assembly to effect electrical energization when the component slides into the cabinet; the cabinet itself carries the corresponding part of the electrical connector assembly.

Normally the connector assemblies are positioned such that they cannot be visually observed when the mating pieces engage one another. Accordingly, when sliding an equipment module into a rack, alignment between the mating pieces becomes very critical. If the two mating connectors are misaligned then damage may occur to projecting pin connectors or blades mounted on the rack or the equipment module. In the past a commonly used connector has been a clip-type female electrical power connector. Typically, a female power connector is attached to the surface or an edge of a back plane of a piece of electrical equipment, the back plane thus functions as a power supply. The equipment module is slid into a rack usually adjacent to several other pieces of equipment. A complementary male power connector attached to the back of the rack is inserted into a female connector on the back of the equipment module as the module is pushed into the rack. In some configurations, the female connector is attached to the back of the rack while the male connector is carried by the equipment module. In either configuration, the connecting procedure is the same. With these type of connectors, "blind mating" occurs because the mating connectors can not be seen as the male connector is inserted in the female connector.

Some existing female power connectors are simply rigid U-shaped clips bolted to the back plane of the equipment while the male connector element is a simple blade received by the U-shaped clip. One disadvantage to these type of clips is that blind mating is very difficult because the rigid nature of this type of clip does not permit compensation for preexisting misalignment between the male connector and the clip (i.e., female connector). In practice, the equipment tediously has to be moved about and adjusted until the male connector aligns with the opening in the female connector. An additional problem for connectors of this type is that the longitudinal axis of the male and the female elements have to be accurately coaxially aligned. If the male connector is not coaxial with the female connector, then the male connector cannot be fully engaged in the female connector and a poor electrical connection may result.

To address the pre-insertion misalignment problem, the prior art has added a guide 15 (FIG. 1) along side of the U-shaped female connector 3. The guide 15 had an elongated opening 2 laterally aligned with the opening between fingers 4. Moreover, the opening 2 included convergently inclined sides 5, 6. With that arrangement, if there was misalignment between the male and female connector elements, the male connector element will contact one of the slanted sides 5, 6 and cammed into opening 2 so that the male connector can be guided to the location between the fingers 4.

However, a problem still exists with regard to the misalignment during insertion. Occasionally, the axis of the male connector is not be perpendicular to its mounting surface or is not coaxial with the axis of the female connector. Such misalignment impedes the mating connection. For example, if the axis 7 (FIG. 2) of the male connector 11 is not coaxial with the axis 8 of the female connector 3 such that there is a difference $\alpha$ in the angular alignment, then the male connector 11 will encounter resistance and bind as it is inserted into the opening 2. As a result, a bending stress will be applied to the male connector 11 at the point 10 which may cause damage to the male connector 11. Another disadvantage of this configuration is the small area of surface contact between the male and female connectors—such small areas give rise to power loss, heat concentrations, and other undesirable operating characteristics.

It is, therefore, desirable to have an electrical power connector that compensates for misalignment, both before insertion and during insertion, between the mating elements of the electrical power connector while also providing enhanced electrical contact between the two mating elements.

SUMMARY OF THE INVENTION

The present invention provides an electrical power connector that provides all the desirable characteristics discussed above while overcoming the deficiencies of the known prior art devices.

An electrical connector assembly in accord with this invention includes a housing of electrically insulating material which substantially contains an electrically conductive clamping element or clip. The housing has an opening at one end with chamfered surfaces which define a convergent guide. A second end of the housing has an opening which communicates with the first opening and which is proportioned to slidably receive the clip so as to substantially surround the clip. A mounting end of the clip extends longitudinally beyond the second end of the housing to space the second end of the housing from a support on which the electrical power connector is mounted. Fasteners securing the mounting end of the clip to its support also accommodate limited lateral translation, as well as delimited angular perturbations of the housing relative to the support. Thus, the angular perturbations can occur in each of two perpendicular planes with the lateral translation occurring in one of those planes. Accordingly, the housing has three degrees-of-freedom to accommodate misalignment.

A further enhancement of the electrical connector includes use of a plurality of parallel elongated contacts, each of which is torsionally biased about its longitudinal axis toward engagement with a mating connector. Preferably, the contacts are aligned an electrically conductive band such that longitudinal axes of the contacts are aligned with the direction of relative movement between the connector elements. Each elongated contact may also be curved outwardly toward the mating connector so that resilient contact elements are provided along opposed interior sides of the clip.

Where each torsional contact has current carrying capacity which is substantially less than the current capacity of the connector assembly, forward ends of the clip may be arranged to protrude inwardly so as to be spaced by a distance smaller than the thickness of the mating connector element. With this arrangement, current surges associated with initial contact between connector elements are handled by the protruding clip ends. Further insertion of the male element into the female connector elements then engages the plurality of torsional contacts without significant risk of burning those torsional contacts.

In accordance with another embodiment of the invention, an electrically conducting arm is provided that can be inserted into the clip of the electrical power connector to convert the electrical power connector from a female connector to a male connector.

BRIEF DESCRIPTION OF THE DRAWINGS

Many objects and advantages of the present invention will be apparent to those skilled in the art when this specification is read in conjunction with the attached drawings wherein like reference numerals are applied to like elements and wherein.

DETAILED DESCRIPTION OF THE PREFERRED EMBODIMENTS

Figure 1:
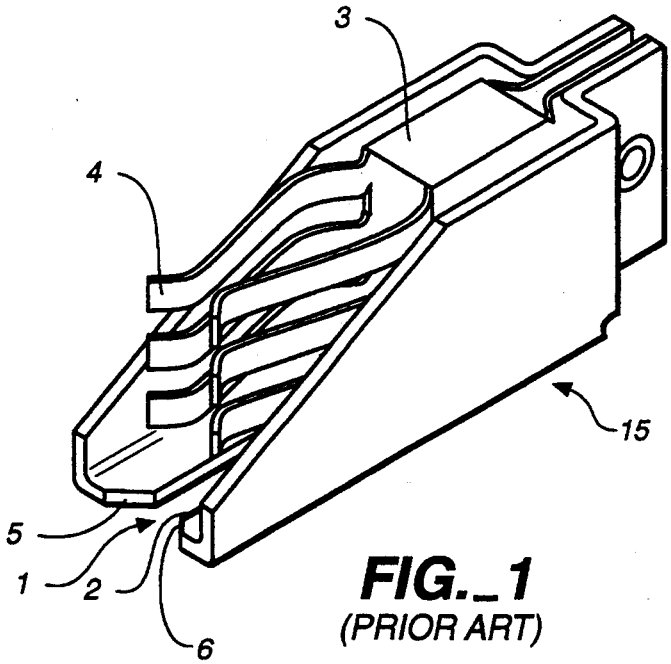
FIG. 1 (PRIOR ART)
FIG. 1 is a perspective view of a prior art electrical power connector with a guide attached.
Figure 2:
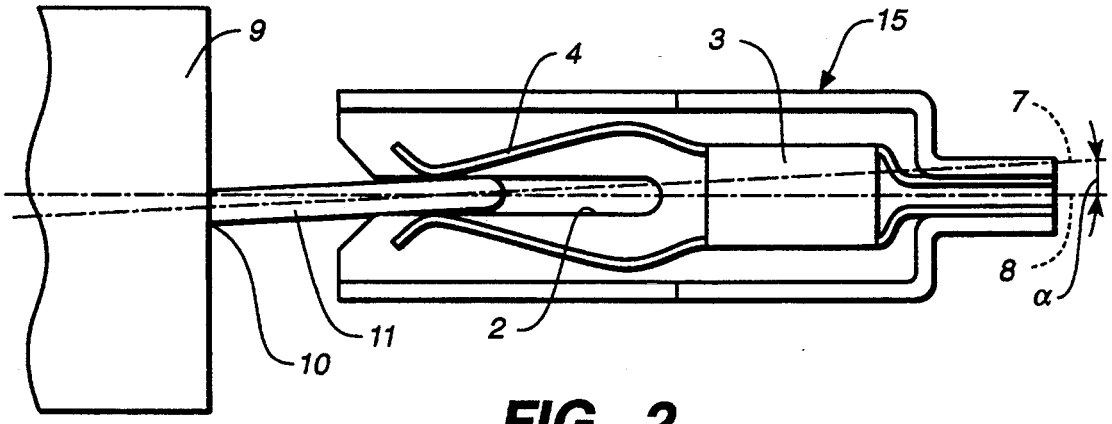
FIG. 2 (PRIOR ART)
FIG. 2 is a plan view of the prior art connector shown in FIG. 1 with a male connector partially inserted in the electrical power connector.
Figure 3:
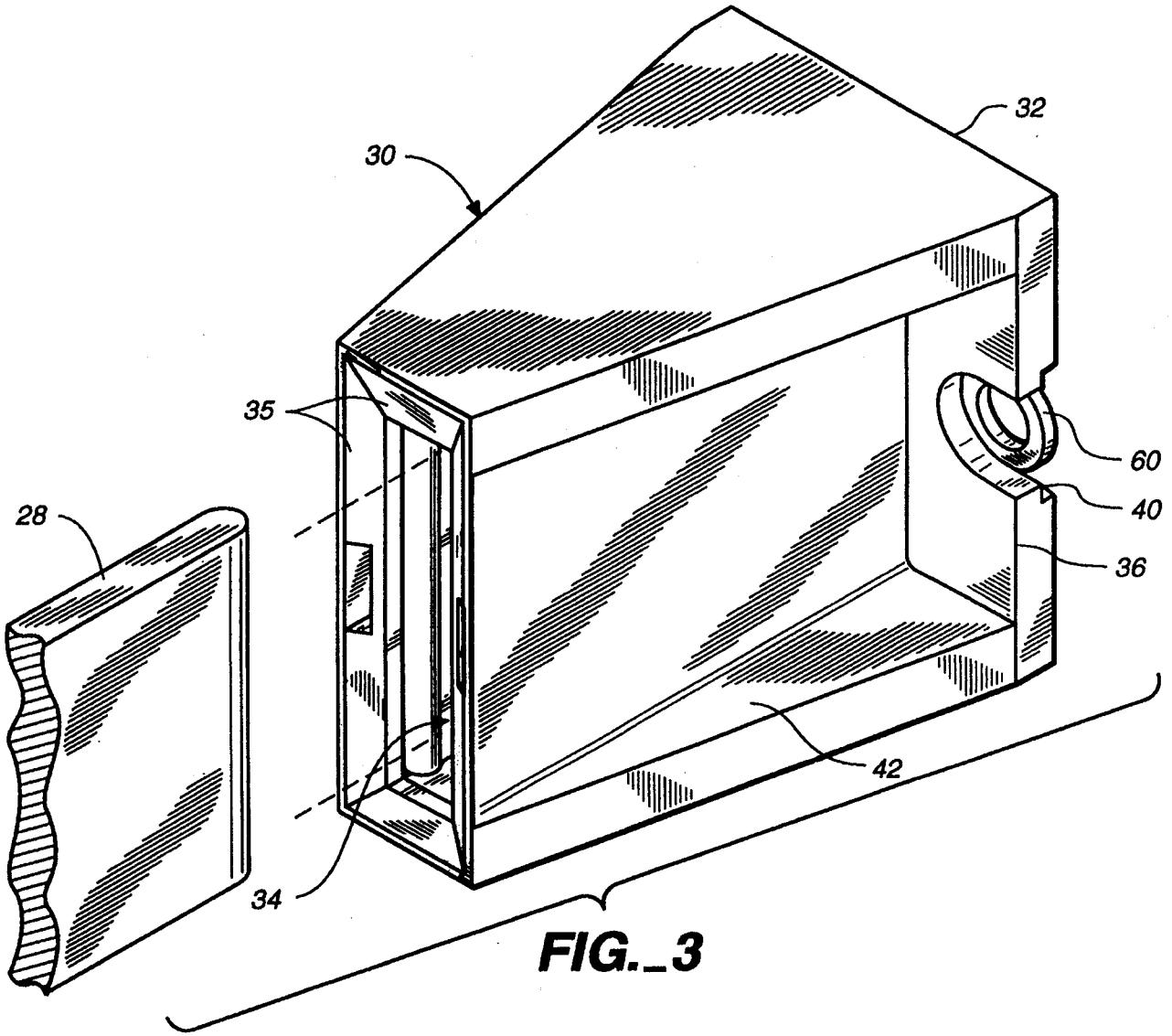
FIG. 3 is a perspective view of the electrical power connector of the present invention and a corresponding mating connector shown just before insertion in the power connector.

An electrical power connector assembly for use in a power distribution system is generally illustrated in FIG. 3. Generally, the assembly includes (i) a plug portion or a male mating connector 28 and (ii) a receptacle portion 30. The principal characteristics of the plug portion 28 that are important for this discussion are the presence of an electrically conductive blade member having predetermined width, predetermined thickness, and predetermined length. The width and thickness of the blade member are proportioned so that the rated current and voltage can be safely transmitted. The length is selected so that the blade will be fully received within the mating receptacle portion 30 without exposing electrically conducting portions thereof to casual contact during use and/or maintenance. As illustrated, the end portion of the blade 28 may be rounded. That rounded end facilitates coupling of the plug portion 28 and the receptacle portion 30 in which electrical contact elements protrude so that lateral clearance is less than the predetermined thickness.

The receptacle portion 30 of the electrical power connector (see FIG. 4) includes a housing 32, an electrically conductive clamping body or clam-shell clip 50, and a pair of crown contact strips 80 (only one of which is shown in the interest of clarity). The housing 32 has a distal end 33 and a proximate end 37. A centrally positioned, generally rectangular opening 34 (FIG. 5) for receiving the male mating connector portion 28 is inset from the distal end 33. The width of the opening 34 is selected to be larger than the predetermined thickness of the mating connector portion 28 and to have a height greater than the width of the mating connector portion 28. Access and guidance toward the opening 34 are facilitated by four inclined or tapered side cam surfaces 35 which slope inwardly (FIG. 6) from the distal end 33 of the housing 32 to the peripheral edge of the opening 34. The side surfaces 35 are inclined with respect to the longitudinal axis of the housing 32 by an angle which is less than 45°. In particular, that angle of the inclined side surfaces is selected so that the surfaces function as cam surfaces to guide the male portion 28 of the connector into the opening 34 without friction locking. In normal operation, if the mating connector 28 is slightly misaligned from the opening 34 in the receptacle portion 30 of the power connector, the tapered sides 35 cause relative positional adjustment between the mating connector 28 and the receptacle portion 30 of the power connector.

Figure 4:
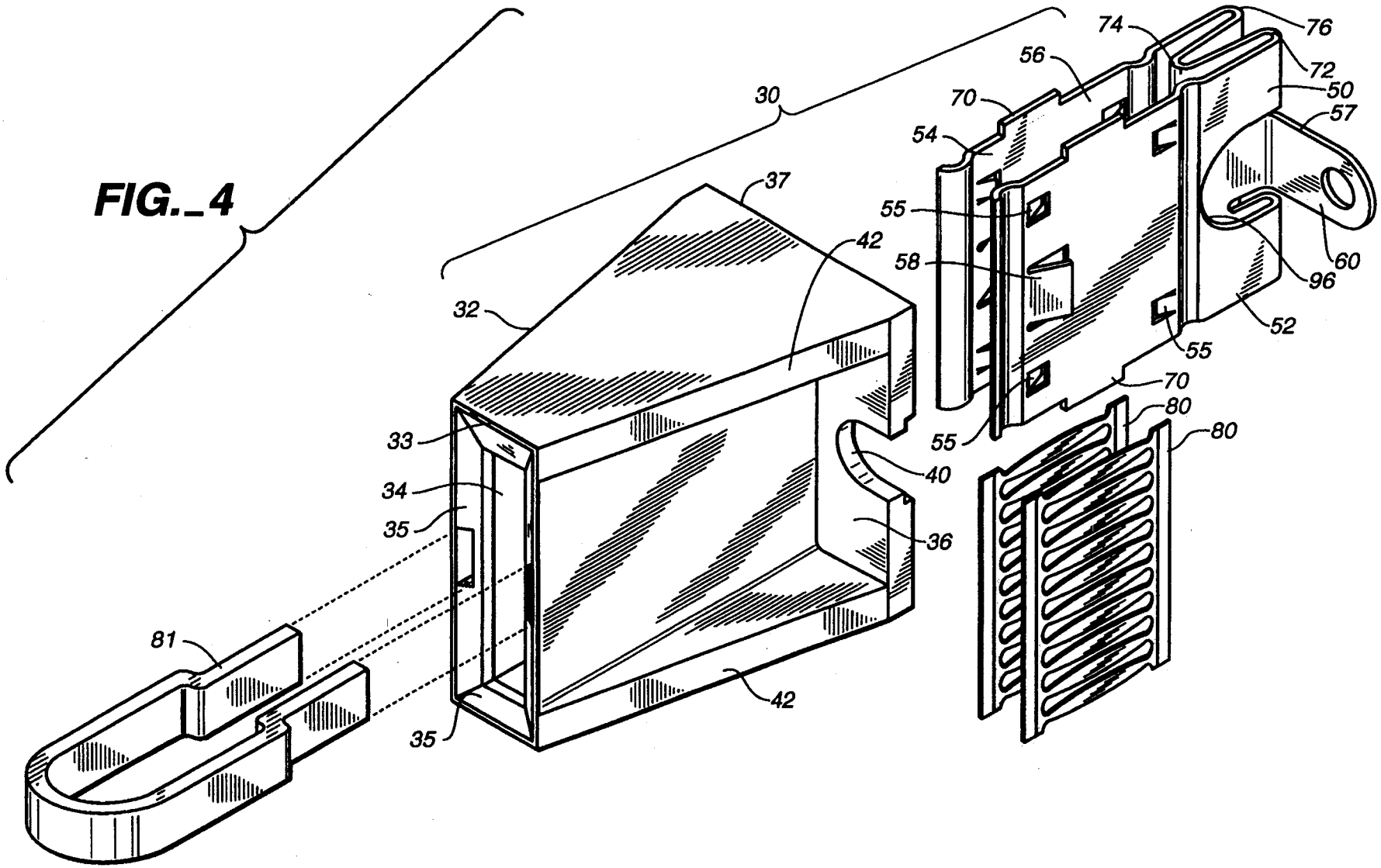
FIG. 4 is an exploded perspective view of the electrical power connector of the present invention with a correspoding latch release tool.
Figure 5:
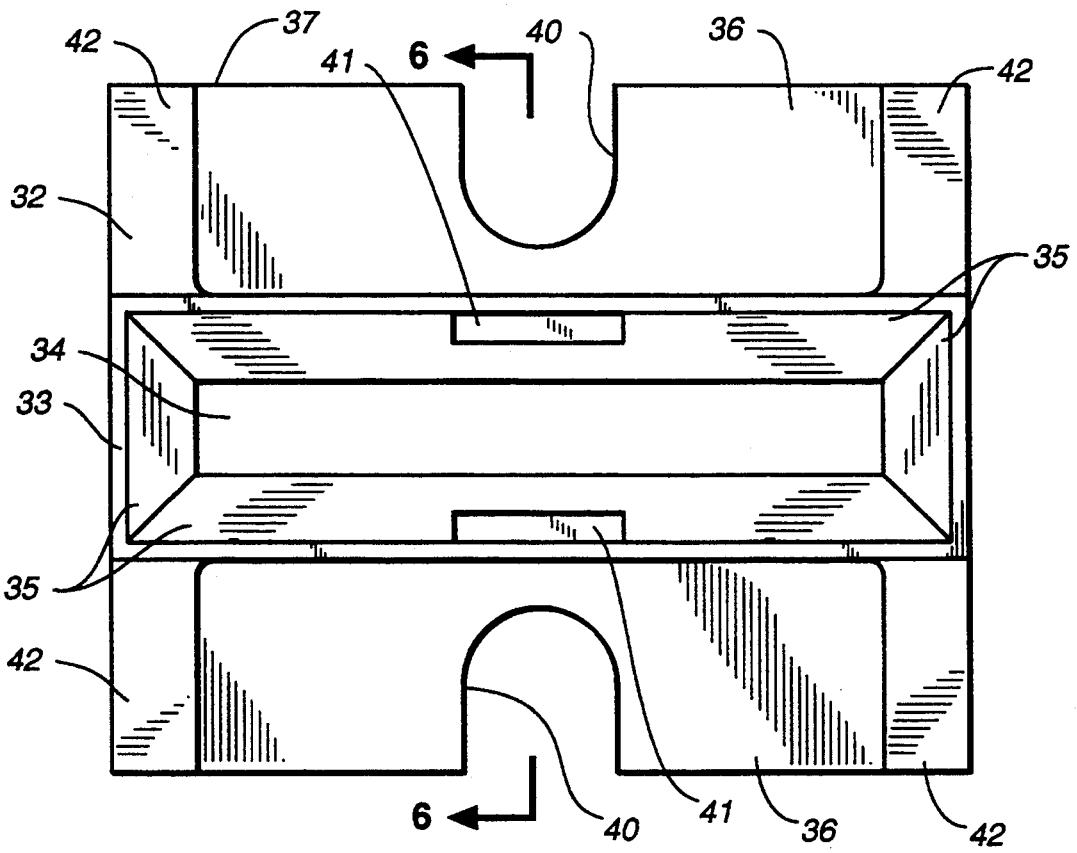
FIG. 5 is a front elevational view of the housing of the electrical power connector.
Figure 10:
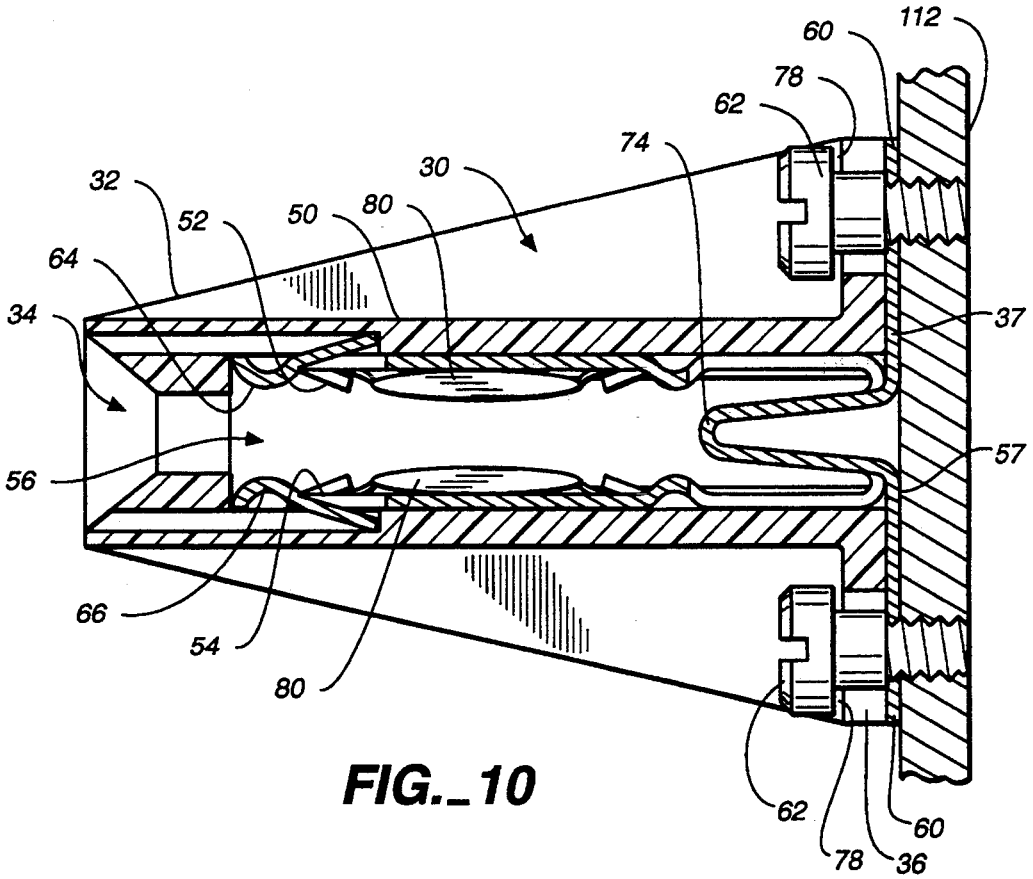
FIG. 10 is a partial cross-sectional view of the assembled electrical power connector of FIG. 3.

As seen in FIG. 4, top side of the housing 32 has a generally trapezoidal shape. Splayed side edges of the top side extend from the distal end 33 to the base or proximate end 37 of the housing 32. The proximate end 37 (FIG. 6) of the housing 32 is substantially wider than the distal end 33 to provide improved lateral support for the power connector assembly. Each lateral side of the housing 32 (FIG. 5) also has a pair of integral rib supports or gussets 42, each rib support 42 being adjacent to a corresponding splayed edge of the side surfaces. Extending between the ribs 42 at the proximate end 37 of the housing 32 is a mounting flange 36, there being one mounting flange on each lateral side of the housing 32. Each mounting flange 36 has a U-shaped connector-receiving recess or gap 40, the recess preferably being centered on the free edge of the corresponding mounting flange 36 and being open outwardly toward that edge. The width of the recess 40 (in the direction of the free edge) is selected to slidably accommodate a smooth shank portion of a mounting screw 62 (FIG. 10). The length of the gap 40 (in a direction generally perpendicular to the free edge) is selected to accommodate predetermined bodily movement of the housing 32 with respect to those mounting screws. The housing 32 is preferably fabricated of a polyester, flame retardant plastic (PBT) but other materials such as any rigid thermoset or thermoplastic may be used. It is of course important that the housing material be an electrical insulator in order to reduce the possibility of electrical shock hazard.

The housing 32 has an internal cavity 39 (FIG. 6) sized and configured to receive, retain, and substantially surround the electrically conductive clamping body or clip 50 (FIG. 4). The internal cavity 39 is open to the proximate end 37 of the housing 32 and extends through the housing 32 so as to communicate with the opening 34. The height of the internal cavity 39 is at least as much as the height of the opening 34 so that the mating connector portion can be received in the internal cavity 39. Moreover, the cavity 39 has a width which exceeds the width of the opening 34 so that the mating connector portion can be received in the clamping body 50 which is also located in the cavity 39. Each side of the cavity 39 may include a means for receiving and retaining a locking protrusion of the clamping body 50. For example, a latch channel or slot 41 may be provided which extends away from the cavity 39 into the housing 32. Each latch channel 41 opens at one end into a corresponding inclined surface 35 in the distal end of the housing 32 and terminates internally of the housing with an abutment surface. In cross section (FIG. 6), each of the latch channels 41 is generally rectangular. By extending the latch channel 41 to the inclined surfaces at the end of the housing, access to those latch channels is provided for a latch release tool 81 (FIG. 4). Each side of the cavity 39 (FIG. 6) also has a pair of guide slots 43, one guide slot being adjacent a corner of the cavity when viewed in cross section (FIG. 7). The guide slots 43 extend from the proximate end 37 of the housing toward the upper end of the internal cavity 39, to proximity with the end of the latching channel.

The clamping body 50 (FIG. 4) has a pair of opposing generally planar sides 52, 54 which are preferably integrally connected at one end, the mounting end, and which are spaced from one another at the other end, the receiving end, by a distance which is less than the width of the opening 34 and less than the thickness of the mating connector element. The edge of each side adjacent to the receiving end is preferably convexly curved to be engaged by the complementary connector element and spread apart. The sides 52, 54 have a width which is less than the height of the cavity 39 and define a slot therebetween.

The clamping body 50 is preferably fabricated of high conductivity, oxygen-free copper, but it is contemplated that other metals such as beryllium copper, aluminum, steel, etc. can be used with attendant lower electrical performance characteristics. The clamping body 50 material preferably has spring-like resiliency. Thicker or thinner material may be used with the attendant changes in electrical performance and resiliency.

Figure 8:
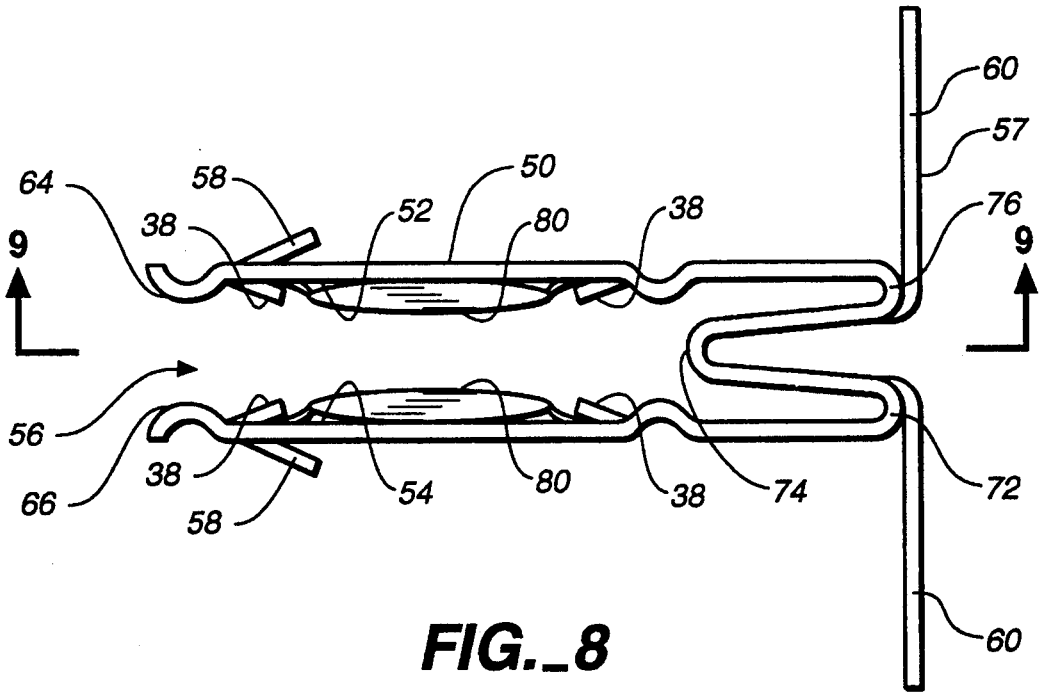
FIG. 8 is a plan view of the electrically conductive clip of the power connector of FIG. 4.

The clamping body 50 preferably has three U-shaped bends or folds 72, 74, 76 of substantially 180° each at the mounting end 57 (FIG. 8). A larger number of folds could be used if desired, however, there should be an odd number of folds so that the sides 52, 54 are substantially parallel and substantially coextensive. Moreover, these folds 72, 74, 76 define interdigitated spaces between the overlapping portions of the clamping body material. By virtue of those spaces, the folds function to provide a spring-like resilience between the sides 52, 54 at the mounting end. In addition, the folds 72, 74, 76 permit the forward ends 64, 66 of the sides 52, 54 to be displaceable away from one another. Furthermore, the arcuate surface of middle fold 74 defines the innermost end of a connector-receiving opening or slot 56 defined between the sides 52, 54.

Figure 9:
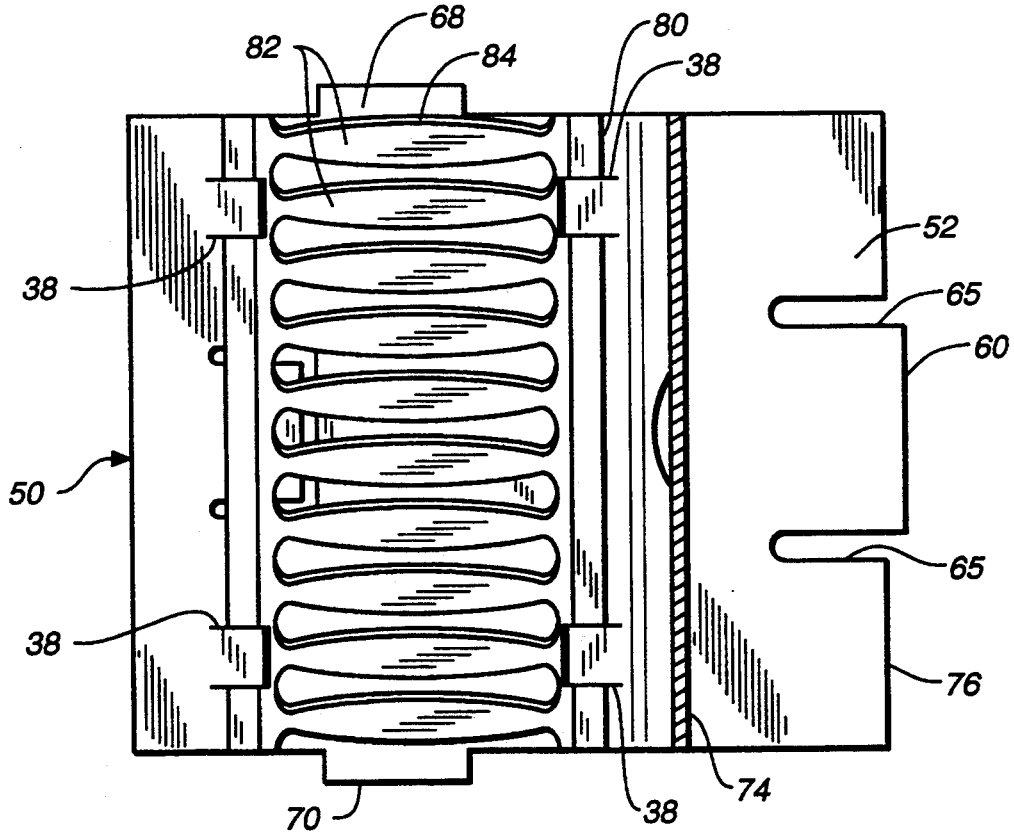
FIG. 9 is a cross-sectional view of the electrically conductive clip taken along line 9—9 of FIG. 8.

The mounting end 57 of the clamping body 50 also includes a pair of mounting ears 60 (FIG. 4). Each ear 60 may be cut from the material of the adjacent side 52, 54 and may extend so as to be substantially perpendicular to the associated side 52, 54 and collinear with the opposed ear. Each ear 60 includes a suitable conventional opening sized to accommodate the threaded end of a screw. Cross sectional dimensions of the ears 60 are selected so that the ear can reliably carry the rated electrical load of the connector assembly. The ears 60 are generally centered along the sides of the clamping body 50 (FIG. 9). The ears 60 are also generally only a small portion of the overall width of the clamping body 50 so that the clamping body has flexibility to rotate about the ears 60. Furthermore, the ears 60 are preferably defined by cuts 65 in the material of the mounting body, the cuts 65 extending from the mounting end at least halfway to the center fold 74. Thus, the cuts 65 sever the outer folds 72, 76 and allow the sides 52, 54 to be displaced relative to the ears 60. The mounting plane defined by the bottom surfaces of the ears 60 is spaced from a plane tangent to the bends 72, 76 (FIG. 8) by a predetermined offset distance or spacing. That offset spacing may, for example, correspond to the thickness of the material from which the body 50 is fabricated. Moreover, that offset spacing may be effected by the relative positioning of the essentially 90° bend between the ear 60 and the associated segment of the clamping body 50.

At least one side 52, 54 of the clamping body 50 has a locking protrusion for securing the housing in position over the clamping body 50. For example, each side 52, 54 may include a projection or tab 58 extending outwardly away from the slot 56 and be arranged so that the end of the locking projection is directed toward the mounting end. Each locking projection 58 is preferably centrally positioned between the longitudinal edges of the corresponding side 52, 54. Moreover, each locking projection 58 is shaped and positioned such that the locking projection can be received in a corresponding latch channel 41 (FIG. 6) of the housing 32. For simplicity, the locking projections 58 of each side 52, 54 are preferably identical, however, it is within the scope of this invention that those projections may have different shapes and/or proportions, if desired.

Each longitudinal edge of the clamping body 50 has an integral, laterally protruding, guide tab 70 (FIG. 4). The guide tabs 70 may be identically shaped, if desired. Moreover, each guide tab 70 is spaced from the free end 64, 66 of the corresponding side so as to be farther from the free end than the latching projection. Each guide tab 70 is sized so that it can be received in a corresponding guide slot 43 (FIG. 7) of the housing 32.

Each side 52, 54 of the clamping body 50 may be provided with an electrically conducting contact band 80 (FIG. 4) having a plurality of crown contacts extending longitudinally in the housing. To position and attach the contact band 80 to the associated side 52, 54, the corresponding side has a retaining means such as a plurality of clips 55. Each clip 55 may be integral with the material of the body 50 and generally rectangular in shape. Each clip 55 projects into the slot 56. The clips may be arranged in two rows spaced to correspond to the width of the band 80, with the clips 55 presenting an opening accessible from the desired position of the band 80. When the band 80 is positioned under the clips 55, the clips can be pressed down into engagement with the edges of the band 80 to secure it in position and in electrical contact with the associated side 52, 54.

Preferably, the band 80 has a multiplicity of curved, resilient crown contact members 82 (FIG. 9). Each contact member 82 has a reduced width portion adjacent each side of the band as well as a formed edge 84 which is deformed downwardly so that the contact member 82 presents a contact that is arcuate in both longitudinal and transverse cross section. The reduced width portions at each end function as torsional springs when the contact edge is deflected and thus resiliently bias the contacts toward a contact position. When the band 80 is attached to the associated side 52, 54 of the body 50, the contact elements 82 protrude farther into the slot 56 than does the end of the associated side 52, 54 (FIG. 10). The band 80 can be a flat band also, or can be flat bands used in sets of two. The resilient contact members 82 provide the electrical connection between the receptacle portion 30 of the power connector and mating connector 28. The band 80 is preferably composed of heat-treatable grade beryllium-copper alloy, but it is contemplated that it may be composed of other electrically conductive metals such as phosphor-bronze, brass, stainless steel, etc. The use of a multiplicity of resilient contact members 82 is advantageous because the large number of contacts accommodates higher amperage connectors, having improved electrical conductivity, lower voltage drop, and less power consumption in the system.

Each forward end 64, 66 of the sides 52, 54 is convex and may be curved (FIG. 8) as shown to facilitate "hot plugging". "Hot plugging" is the assembly of the male mating connector portion 28 to the mating receptacle portion while an electrical potential exists between the male connector and the receptacle portion 30. This electrical potential can result in arcing between the mating connector 28 and the first contact member 82 to approach it. Such arcing can erode or melt the thin foil electrical band 80 causing damage thereto and thereby reducing the performance of the receptacle portion 30. By establishing the spacing between the rounded ends 64, 66 to be less than the thickness of the mating connector portion 28, initial electrical contact will occur between the connector portion 28 and the rounded ends, rather than the thin contacts 82. Heavier material thickness of the sides 52, 54 can accommodate the initial power surges without damage. Nevertheless, as the connector portion 28 moves farther into the receptacle portion 30, the connector portion 28 engages the contact members 82—but without an electrical potential therebetween so that the possibility of arcing is substantially avoided. In operation, as the mating connector 28 is moved into near contact with the indentations 64, 66 the initial arc is absorbed by the indentations 64, 66 then the mating connector 28 can be pushed further into the receptacle portion 30 of the power connecter. In other words, the indentations 64, 66 operate essentially as a switch. The indentations 64, 66 absorb the initial arc and operate to close the circuit. In this way, the indentations 64, 66 preclude electrical arcing between the mating connector 28 and the thin foil electrical band 80 which prevents damage to the electrical band 80. Only after an electrical connection has been established between the mating connector 28 and the clamping body 50, eliminating the arc producing electrical potential, does the mating connector 28 approach electrical band 80 and the thin crown contact elements.

Figure 6:
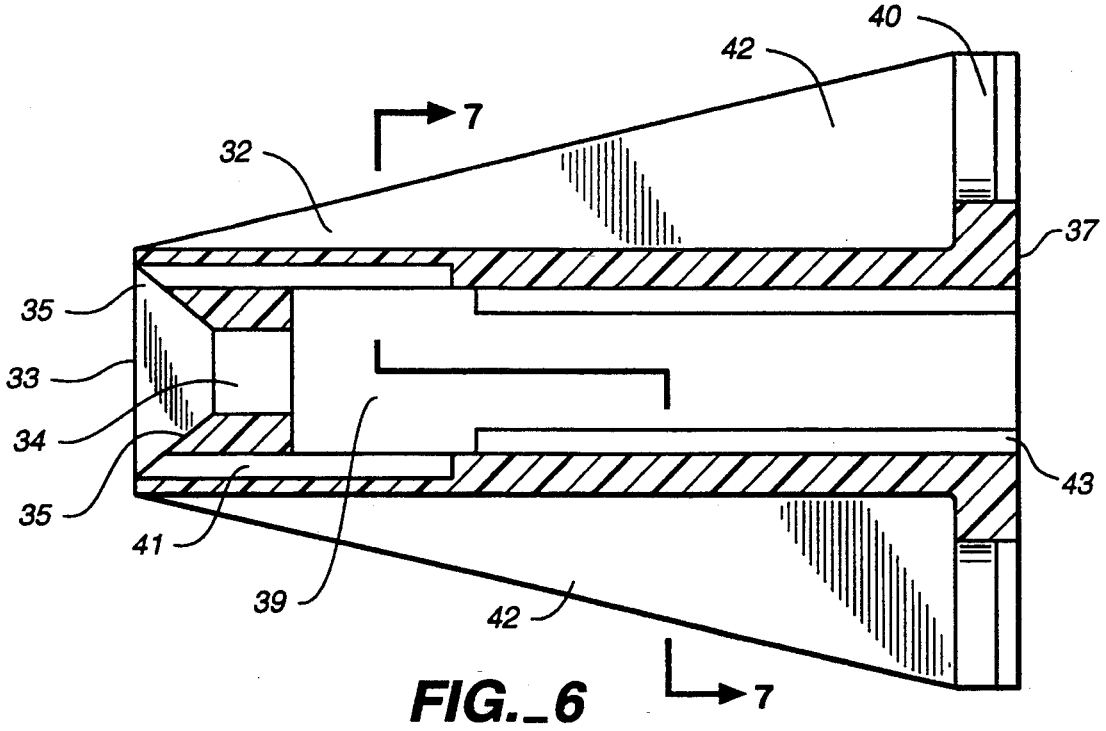
FIG. 6 is a cross-sectional view taken along the line 6—6 of FIG. 5 showing internal characteristics of the housing.
Figure 7:
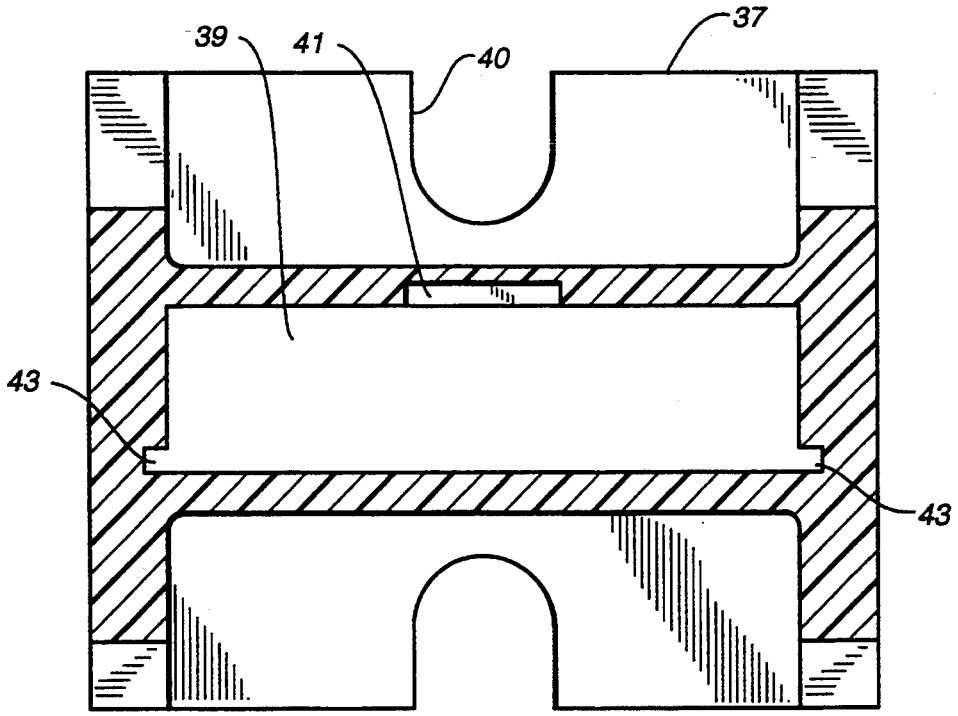
FIG. 7 is a cross-sectional view taken along the line 7—7 of FIG. 6 showing further characteristics of internal features of the housing.

With foregoing arrangement of slots, guides, and tabs, when the housing 32 slides down over the clamping body 50, the tabs 70 (FIG. 4) on each side 52, 54 are received in, and guided by, the corresponding guide slots 43 as the body 50 enters the internal cavity 39 (FIG. 6). When the body 50 is substantially inserted into the internal cavity 39, the locking projections 58 spring outwardly into the corresponding latch channels 41 (FIG. 10). The locking projections 58 engage the abutment ends of those channels 41, and securely lock the housing 32 in place over the clamping body 50. The guide slots 43 and cooperating guide tabs 70 operate to maintain a predetermined spacing between the two opposing sides 52, 54 of the clamping body 50. In this regard, the tabs 70 also effectively shorten the cantilever arm of the sides (compared to the distance to the bends 72, 76) and thereby stiffen the forward edges 64, 66 of the sides 52, 54 against lateral displacement.

Through interactions between the housing 32 and the clamping body 50, the free ends 64, 66 are initially constrained to a predetermined spacing, preferably such that the spacing between those ends 64, 66 at the open end of the slot 56 is slightly more narrow than the thickness of the mating connector 28. As a result, mating connector 28 cannot enter slot 56 without first establishing contact, and thus an electrical connection, between the mating connector 28 and the ends 64, 66. As the mating connector 28 is inserted farther into the clamping body 50, the ends 64, 66 of the clamping body 50 are forcibly deflected outwardly to accommodate the thickness of the mating connector 28. The housing 32 also prevents permanent deformation of the clamping body 50. In other words, the housing 32 prevents the opposing sides 52, 54 of the clamping body 50 from permanently separating or spreading apart after multiple uses of the receptacle portion 30 of the power connector.

Figure 11:
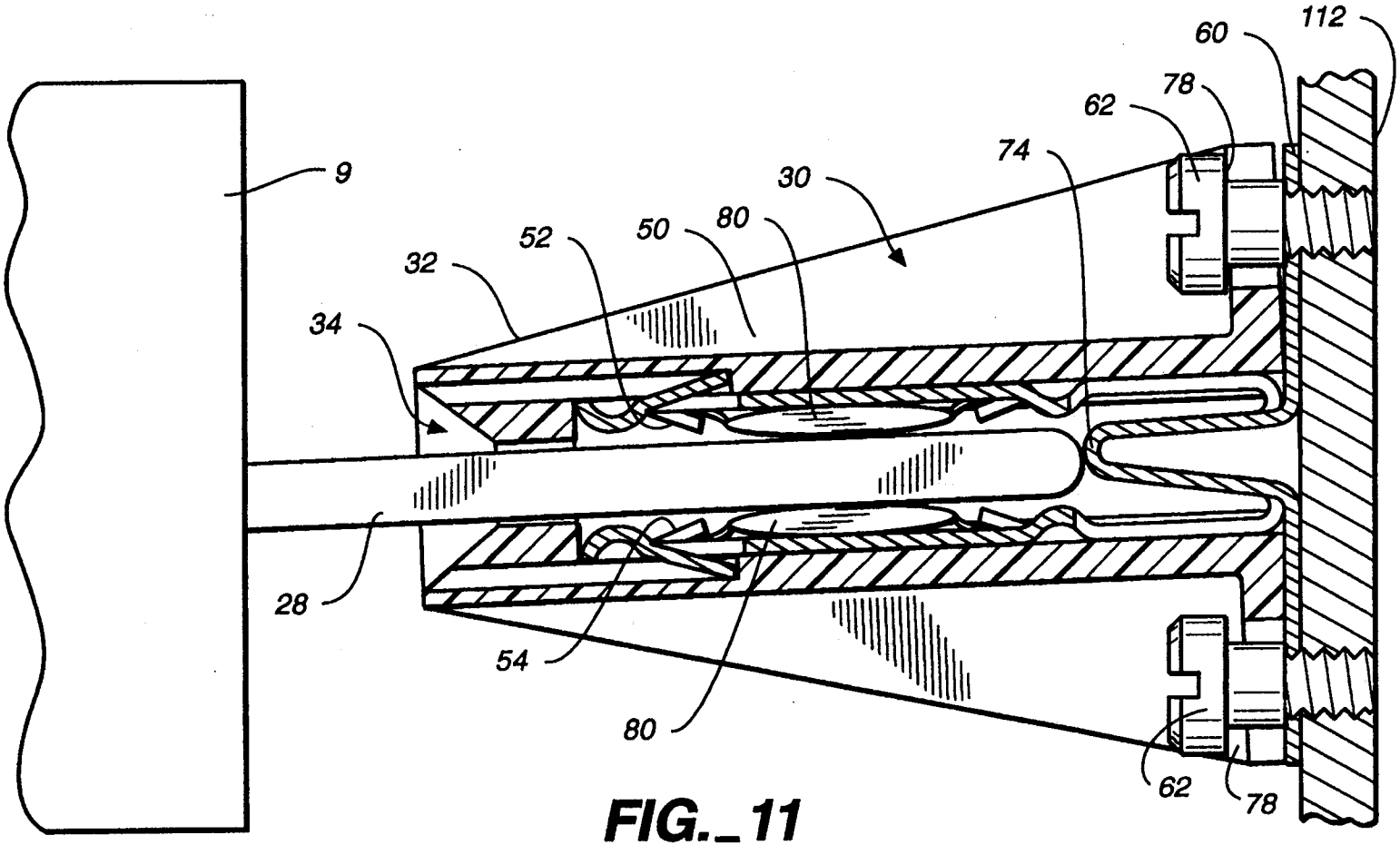
FIG. 11 is a partial cross-sectional view of the electrical power connector, similar to FIG. 10, but illustrating pivoting movement of the electrical power connector to accommodate for misalignment with the mating connector.

The forward surface of the center bend 74 of the clamping body 50 functions as a mechanical stop when the mating connector portion 28 is inserted in the receptacle portion 30 (FIG. 11).

When the clamping body 50 is latched in position in the internal cavity of the housing 32, the proximate end 37 of the housing 32 is offset or spaced from the mounting plane 67 of the mounting ears 60 (FIG. 10). Furthermore, the ears 60 are positioned so as to be accessible through the U-shaped openings 40 in the housing flanges (FIG. 3). Accordingly, when screws 62 (FIG. 10) are used to mount the connector assembly to a back plane 112, the threaded portion of the screw 62 passes through the corresponding ear 60. The back plane 112 may be a piece of electrical equipment or a bus bar.

The preferred screws 62 for use with this connector assembly are shoulder screws having an enlarged diameter shank 63 between the screw head and the screw threads. As a result, when the screw 62 is tightened into the back plane 112, the forward end of the enlarged diameter shank 63 bears against the upper surface of the ear 60 and tightly clamps the ear against the back plane 112 and into electrical contact therewith. In addition, the enlarged diameter shank 63 has an axial length which exceeds the thickness of the mounting flange 36. Thus, when the screw 62 is fully engaged, a space 78 exists between the underside of the screw head and the top of the flange 36.

The structural arrangement of the clamping body 50 and the associated housing 32 define a receptacle portion 30 which is capable of a variety of adjusting movements to accommodate misalignment between the receptacle portion and a mating dement. More particularly, the offset space (FIG. 10) between the mounting plane 57 of the body 50 and the proximate end 37 of the housing 32, allows the distal end of the housing 32 to rotate about an axis between the screws 62, i.e., in the plane of the sides 52, 54. Further, the space between the screw heads and the surface of the housing flange 36 allows the distal end of the housing 32 to rotate about an axis perpendicular to the line between the screws 62, i.e., in the plane of FIG. 10. In this connection, FIG. 11 shows the receptacle 30 in a slightly pivoted position in the plane of the paper. By virtue of (i) the recursive folds in the mounting end of the body 50, (ii) the spacing between screw heads and sides of the housing 32 (FIG. 10), (iii) length of the U-shaped gaps 40, (iv) the depth of the cuts 65 (FIG. 9), (v) movement of the receptacle portion 30 over clamping body 50, and (vi) the clearance between housing 50 and the top of mounting foot 60 the housing is capable of bodily movement against resilience of the clamping body 50 even though the clamping body is securely attached to the back plane 112.

One aspect of the ability to accommodate misalignment is best seen in FIG. 11. The receptacle portion 30 of the power connector is mounted perpendicular to the back plane 112. The mating connector portion 28 is not perpendicular to the receptacle portion 30 of the electrical equipment to which it is attached, thus causing misalignment between the receptacle portion 30 and the mating connector portion 28 of the connector assembly. However, the receptacle portion 30 of the present invention compensates for this misalignment and provides a sound electrical connection without placing a bending stress on the mating connector 28.

In operation, the receptacle portion 30 of the power connector pivots with respect to the back plane 112. As illustrated, when the receptacle portion 30 of the power connector bends forward the space 78 between the bottom of the head of the mounting screw 62 and the top of the mounting flange 36 on one side of the housing 32 is reduced while the space 78 on the other side is increased. Simultaneously, because the mounting ears 60 of the clamping body 50 are attached firmly to the back plane 112, the arch 74 deflects to accommodate the bending stress applied to the receptacle portion 30 of the power connector. In this way, the mating connector 28 does not bind or encounter major resistance as it is inserted in the receptacle portion 30 of the power connector. Similarly, the receptacle portion 30 of the power connector tilts to accommodate side-to-side misalignment, except that the mounting ears 60 twist to accommodate the bending stress.

Figure 12:
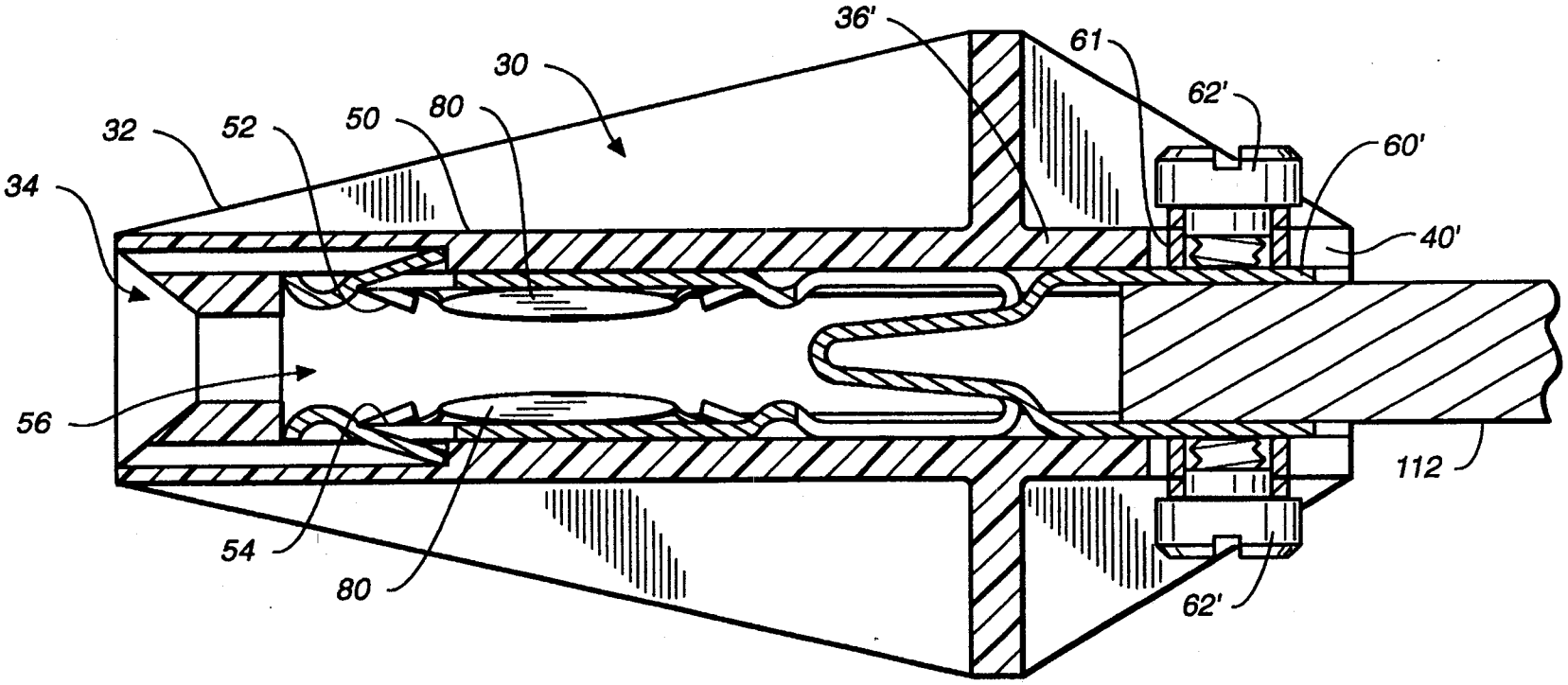
FIG. 12 is a partial cross-sectional view of a second embodiment of the electrical power connector configured for an axial mounting.

In another embodiment, the receptacle portion 30 of the power connector illustrated in FIG. 12 is axially mounted on the back plane 112 (i.e., on an edge of the back plane) but operates essentially the same as the connector described above. In this embodiment, the mounting flanges 36' extend parallel to one another rather than being essentially collinear as in the embodiment of FIG. 4. In addition, the mounting ears 60' are formed to be substantially parallel to the sides 52, 54 of the clamping body 50 and are spaced apart from one another by a thickness corresponding to the thickness of the back plane 112 while also being spaced from the adjacent mounting flanges 36'. Each ear 60' may also include a collar 61 which extends upwardly through the U-shaped opening 40' of the flange 36'. A suitable bolt arrangement 62' may bear on the end of the collars 61, pressing them against the back plate 112.

Figure 13:
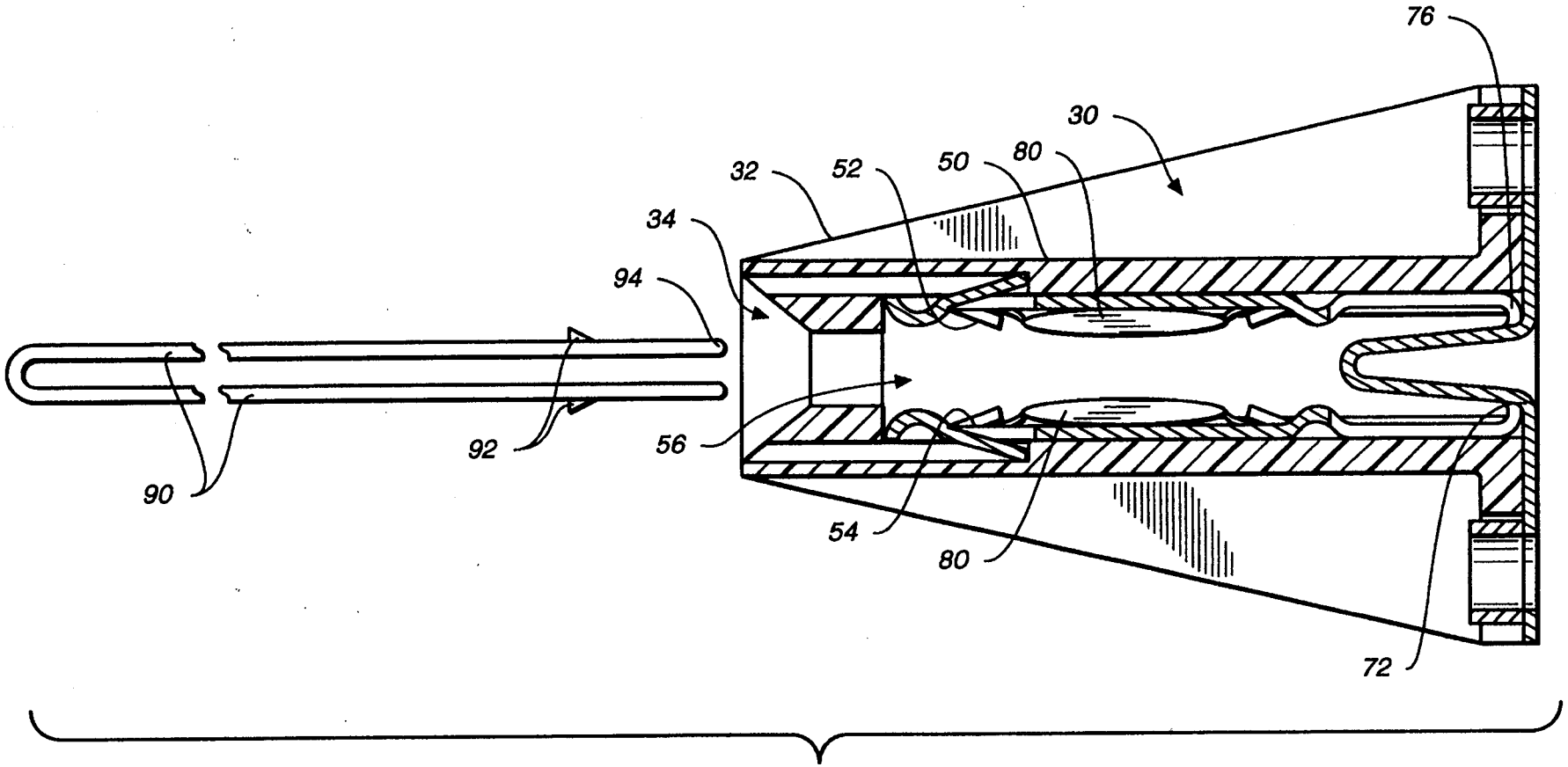
FIG. 13 is a partial cross-sectional view of the electrical power connector of FIG. 3 with an electrically conducting arm prior to assembly thereof.

To convert the receptacle portion from a female to a male connector portion, an electrically conducting arm 90 (FIG. 13) may be provided. The arm 90 can be inserted in the receptacle portion 30 of electrical power connector to effect the gender conversion. Locking protrusions 92 are preferably provided near the blind end 94 of the arm and spaced from the end 94 so as to engage the recess 96 (FIG. 4) in each corresponding side 52, 54 of the clamping body 50 from which the mounting ear 60 was formed. The blind ends 94 (FIG. 13) of the arm 90 bottom in the bends 72, 76 as the projections 92 spring into locking relationship with the recesses 96 thereby locking the arm 90 in the slot 56 between the two opposing sides 52, 54. The arm 90 can be solid or can be stamped out of sheet metal with bumps or spacers formed in the arm to maintain the spacing between each side of the arm.

Figure 14:
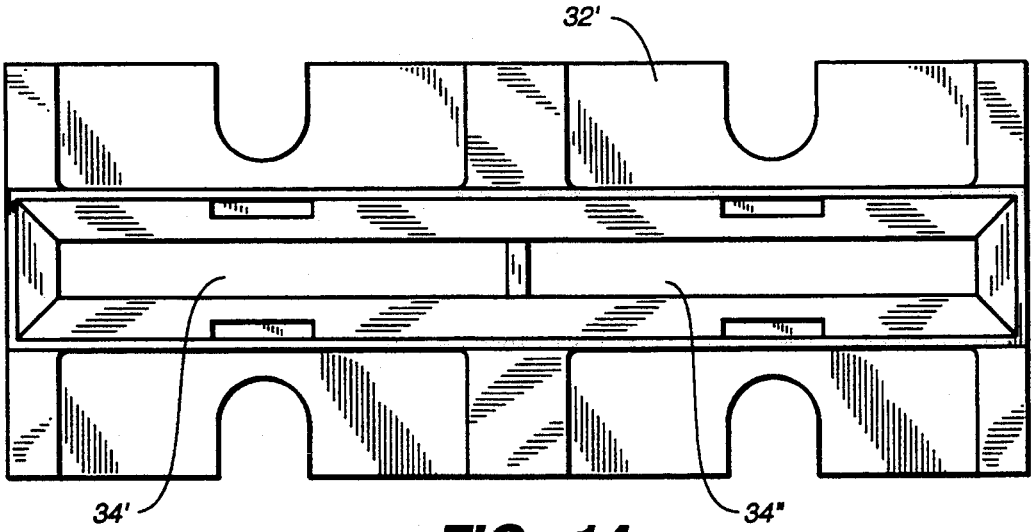
FIG. 14 is a front elevational view of a housing designed for double rated current capacity.

It is further contemplated that multiple clamping bodies 50 can be coupled together under a single housing 32' (FIG. 14) to produce corresponding multiples of current capacity connectors. For example, the housing 32' is designed to accommodate two clamping bodies 50 identical to the one described above and includes a plurality of internal cavities as described above. Each clamping body 50 would be latched in place in a corresponding internal cavity behind a corresponding opening 34', 34" of the housing 32'. For higher current capacity multiples, the housing could be correspondingly incrementally increased to accommodate the required number of clamping bodies 50.

Figure 15:
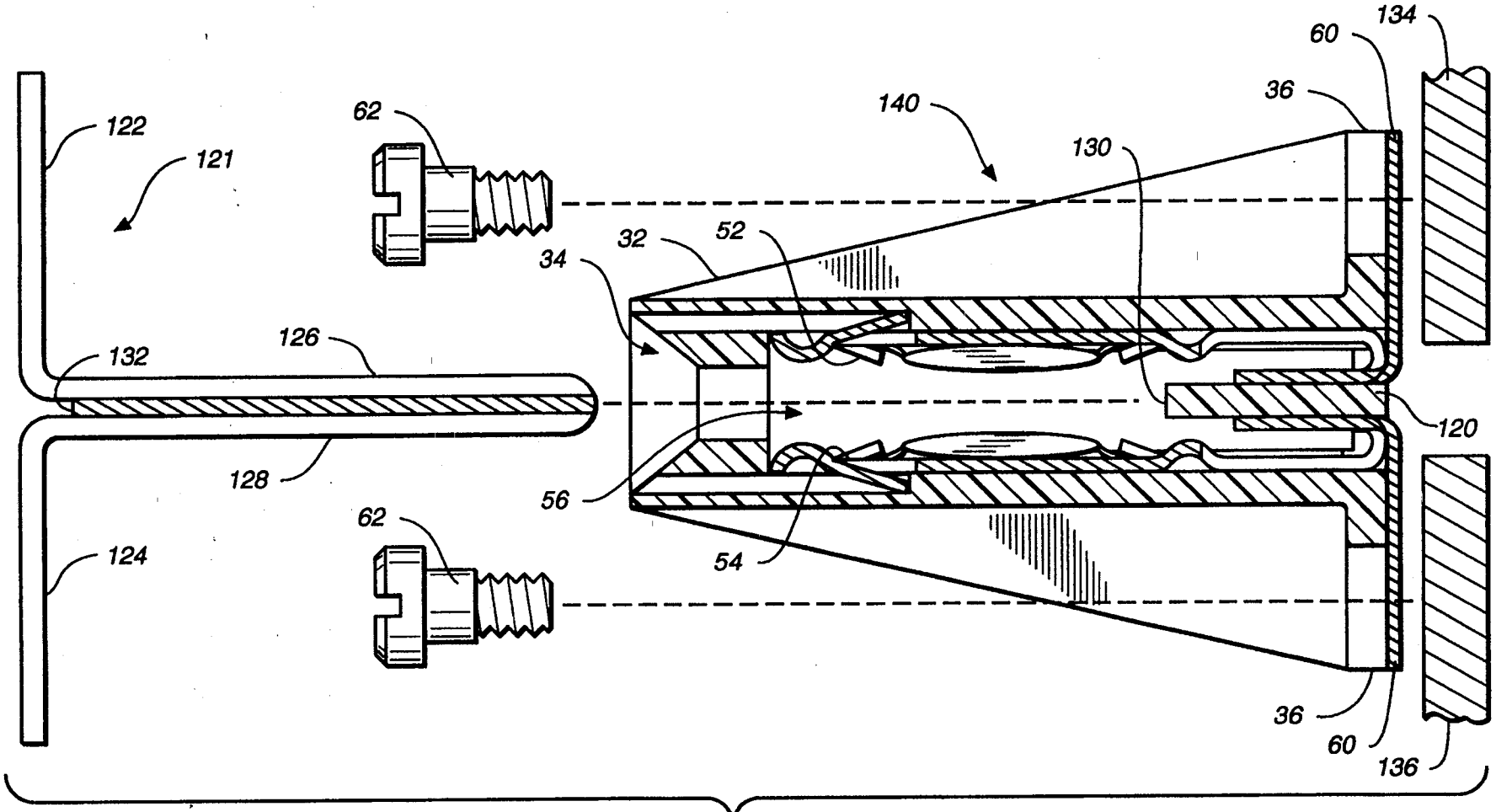
FIG. 15 is a partial cross-sectional view of an input-/output electrical connector.

In another embodiment, an input/output configuration is provided (FIG. 15). In the input/output configuration, the two opposing sides 52,54 of the clamping body 50 are electrically isolated by the removal of arch 74. The housing 32 is as described above with the addition of a separator 120 which replaces the arch 74. Preferably, the separator 120 is integrally molded with housing 32. The electrical connector 140 is connected to isolated mountings 134,136 by mounting screws 62. The mating connector 121 is comprised of two separate electrically conductive sides 122,124. The surfaces 126,128 are separated by a dielectric spacer 132. When the mating connector 121 is inserted into the opening 56, the tip 130 of separator 120 acts as a mechanical stop, similar to previously described center bend 74. The electrically conductive side 122 has an input surface 126 which makes electrical contact with opposing side 52 when mating connector 121 is inserted into opening 56. The electrically conductive side 124 has an output surface 128 which makes electrical contact with opposing side 54. The input/output mating connector 121 operates as a conventional input/output connector.

While the housing 32 of the receptacle portion 30 is described and illustrated above as being rectangular in cross section, the housing cross section could be round, polygonal or any other desired shape.

It will now be apparent that an electrical connector has been described which overcomes the problems and deficiencies associated with prior devices. Moreover, it will now be apparent to those skilled in the art that various modifications, variations, substitutions, and equivalents exist for various elements of the invention but which do not materially depart from the spirit and scope of the invention. Accordingly, it is expressly intended that all such modifications, variations, substitutions and equivalents which fall within the spirit and scope of the invention as defined by the appended claims be embraced thereby.

The invention claimed is:

1. An electrical power connector for connection with a mating connector in a power distribution system, comprising:

a housing having a proximate end, a distal end, an internal cavity, and an opening at the distal end communicating with the internal cavity; and an electrically conductive clamping body disposed within the housing cavity, having a mounting end and a receiving end, an opening at the receiving end aligned with the opening at the distal end of the housing, the mounting end of the clamping body extending beyond the proximate end of the housing, the housing being angularly moveable about the proximate end in two generally perpendicular planes and with respect to a support when the electrical power connector is attached to a power distribution system.

2. The electrical power connector of claim 1 wherein:

the internal cavity has a height and a thickness; and the clamping body includes two opposing sides, having a distance therebetween and a width less than the cavity height, and defining a slot at the receiving end.

3. The electrical power connector of claim 2 wherein:

an integral mounting ear is formed from material of each opposing side at the mounting end of the clamping body; and the two opposing sides of the clamping body are connected by a plurality of U-shaped bends which cooperate to resiliently accommodate displacements of the housing relative to the mounting ears.

4. The electrical power connector of claim 3 wherein three U-shaped bends connect the two opposing sides, a middle U-shaped bend also defining a bottom of the slot.

5. The electrical power connector of claim 4 wherein the integral mounting ears are formed so as to be connected to the middle U-shaped bend to promote torsional flexibility relative to the mounting ears.

6. The electrical power connector of claim 3 wherein the mounting ears extend beyond the proximate end of the housing such that the housing is pivotable about the mounting ears.

7. The electrical power connector of claim 6 wherein the mounting ears are substantially collinear and provide a surface mountable electrical power connector.

8. The electrical power connector of claim 6 wherein the mounting ears are substantially parallel and provide an edge mountable power connector.

9. The electrical power connector of claim 3 wherein each mounting ear includes an upstanding collar.

10. The electrical power connector of claim 2 wherein the proximate end of the housing includes mounting flanges, and a plurality of rib supports extend from the distal end to the proximate end of the housing to stiffen the housing.

11. The electrical power connector of claim 2 further including an electrically conducting arm inserted in the slot between the two opposing sides and projecting from the housing to convert the electrical power connector from a female receptacle to a male plug.

12. The electrical power connector of claim 11 wherein:

the opposing sides include lock recesses at the mounting end; and the electrically conducting arm includes lock elements at an end thereof, the lock elements engaging the lock recesses of the opposing sides to retain the conducting arm in the electrical power connector.

13. The electrical power connector of claim 2 wherein:

the housing opening has a predetermined width; and the housing constrains the slot between the two opposing sides of the body to a predetermined spacing less than the predetermined width.

14. The electrical power connector of claim 13 wherein:

the housing opening is inset from the distal end of the housing, and inclined cam surfaces extend from the distal end of the housing to the housing opening to guide a complementary connector element into the housing opening.

15. The electrical power connector of claim 13 wherein:

each of the opposing sides includes a pair of laterally extending guide tabs; and the housing includes corresponding guide slots extending from the proximate end to a middle of the internal cavity so that the guide tabs are positioned in the guide slots to position the opposing sides in the internal cavity.

16. The electrical power connector of claim 2 wherein the clamping body further comprises a locking protrusion for securing the housing over the clamping body.

17. The electrical power connector of claim 16 wherein the housing further comprises a means for receiving and retaining the locking protrusion of the clamping body.

18. The electrical power connector of claim 17 wherein the means for receiving and retaining the locking protrusion includes a latch channel in the housing, one end of the latch channel being open to the internal cavity.

19. The electrical power connector of claim 18 wherein each opposing side of the body includes an integral latch tab, and each latch tab is received by a corresponding latch slot.

20. The electrical power connector of claim 19 wherein the latch slot is open to the distal end of the housing so that the latch tab is accessible by a latch release tool for disassembly of the housing from the clamping body.

21. The electrical power connector of claim 2 wherein the distance between the two opposing sides defining the slot is smaller than the thickness of the mating connector so as to provide initial electrical contact between the clamping body and the mating connector when the mating connector is inserted in the clamping body.

22. The electrical power connector of claim 21 wherein the receiving end of each opposing side is convexly contoured to present contacts which are spaced by a thickness less than the thickness of the housing opening.

23. The electrical power connector of claim 21 wherein each side includes a plurality of crown contacts, each of which protrudes farther into the slot than the receiving end of the clamping body sides.

24. The electrical power connector of claim 21 further comprising:

an electrical band having a plurality of electrically conductive, curved, resilient contact members; and an electrical band retaining means for retaining the electrical band along the side of the slot defined by the two opposing sides.

25. The electrical power connector of claim 24 wherein each of the contact members is mounted by torsionally resilient elements so as to be resiliently biased toward a contact position.

26. The electrical power connector of claim 25 wherein:

the housing includes a plurality of internal cavities and a corresponding plurality of openings in the distal end thereof, and a corresponding plurality of clamping bodies is provided, each clamping body being disposed in a corresponding one of the plurality of internal cavities.

27. An electrical power connector for mounting on a back plane and connecting to a mating connector in a power distribution system, comprising:

a clam-shell mounting body having a mounting end, a receiving end, and two opposing sides extending from the mounting end to the receiving end, the two opposing sides defining a slot at the receiving end;

a locking protrusion on at least one of the sides of the clam-shell mounting body;

a housing surrounding the clam-shell mounting body for constraining each side of the clam-shell mounting body, having a proximate end, a distal end, and an opening at the distal end aligned with the slot at the receiving end of the clam-shell mounting body;

means on the housing for receiving and retaining the locking protrusion of the clam-shell mounting body;

the proximate end of the housing is offset from the mounting end of the clam-shell mounting body so that when the electrical power connector is mounted on a back plane there is a gap between the proximate end of the housing and the back plane allowing the electrical power connector freedom of pivotal movement with respect to the back plane.

28. The electrical power connector of claim 27 further comprising an electrically conducting arm for inserting in the slot between the two opposing sides to convert the electrical power connector from a female connector to a male connector.

29. The electrical power connector of claim 28 wherein the distance between the two opposing sides defining the slot is smaller than the thickness of the mating member so as to provide initial electrical contact between the clam-shell mounting body and the mating connector when the mating connector is inserted in the clam-shell mounting body.

30. The electrical power connector of claim 28 wherein the housing constrains the slot between the two opposing sides of the clam-shell mounting body to a predetermined distance.

31. The electrical power connector of claim 29 further comprising:

an electrical band having a plurality of electrically conductive, curved, resilient contact members; and an electrical band retaining means for retaining the electrical band along the side of the slot defined by the two opposing sides.

32. An electrical power connector for connecting to a mating connector in a power distribution system, comprising:

an electrical band having electrically conductive, curved, resilient contact members;

an electrical band holder having:

two opposing sides having at least one locking protrusion on each side and a passage between the two opposing sides;

an electrical band retaining means for retaining the electrical band along the passage between the two opposing sides; and at least one mounting flange; and a housing slidably engaged over the electrical band holder for constraining each side of the electrical band holder, having a tapered opening adjacent one end of the passage between the two opposing sides and means for receiving and retaining the locking protrusion of the electrical band holder;

said housing having at least one mounting flange spaced from the mounting flange of the electrical band holder so that the electrical power connector has multiple degrees of freedom in movement when being connected to the mating connector.

33. The electrical power connector of claim 32 further comprising an electrically conducting arm for inserting in the slot between the two opposing sides to convert the electrical power connector from a female connector to a male connector.

34. The electrical power connector of claim 32 wherein the passage between the two opposing sides is smaller than the thickness of the mating connector so as to provide electrical contact between the electrical band holder and the mating member.

35. The electrical power connector of claim 32 wherein the housing constrains the passage adjacent to the opening and between the two opposing sides to a predetermined distance.

* * * * *